United States Patent [19]

Hofer et al.

[11] 4,431,213

[45] Feb. 14, 1984

[54] PRESSURE-SENSITIVE RECORDING MATERIAL

[75] Inventors: Arnold Hofer; René Graf, both of Muttenz, Switzerland; James H. Astbury, Stockport, England

[73] Assignee: Ciba-Geigy AG, Basel, Switzerland

[21] Appl. No.: 218,745

[22] Filed: Dec. 22, 1980

[30] Foreign Application Priority Data

Dec. 20, 1979 [CH] Switzerland ..... 11318/79

[51] Int. Cl.[3] ..... B41M 5/16; B41M 5/22

[52] U.S. Cl. ..... 282/27.5; 428/327; 428/341; 428/342; 428/530

[58] Field of Search ..... 282/27.5; 427/150–153; 428/307, 323, 327, 411, 530, 537, 320.4, 320.6, 320.8, 341, 342

[56] References Cited

U.S. PATENT DOCUMENTS 3,906,123 9/1975 Vincent et al. ..... 428/411

4,025,090 5/1977 Petitpierre ..... 428/411

*Primary Examiner*—Bruce H. Hess

*Attorney, Agent, or Firm*—Wenderoth, Lind & Ponack

[57] ABSTRACT

A pressure-sensitive recording material which contains, on at least one support, at least one color former and one inorganic developer therefor applied in the form of coatings, said coatings additionally containing a urea-formaldehyde condensate with a BET specific surface area of 3 to 30 $m^2/g$.

12 Claims, No Drawings

PRESSURE-SENSITIVE RECORDING MATERIAL

The present invention relates to a pressure-sensitive colour-reactive recording material which contains, on at least one support, at least one colour former and one inorganic developer therefor applied in the form of coatings, said coatings additionally containing a urea-formaldehyde condensate having a BET specific surface area of 3 to 30 $m^2/g$.

The BET specific surface area is determined by the nitrogen adsorption method of Brunauer, Emmett and Teller [cf. Chem. Ing. Techn. 32, 349–354 (1960) and 35, 568–589 (1963)]. The urea-formaldehyde condensates employed in this invention (hereinafter referred to as UF condensates) advantageously have a BET specific surface area of 3 to 25 $m^2/g$, preferably 5 to 12 $m^2/g$ and, most preferably, 5 to 9 $m^2/g$.

The UF condensates suitable for the recording material of the invention are known per se. These UF condensates and the production thereof are described e.g. in the article by A. Renner in "Die Makromolekulare Chemie" 149, pp. 1–27 (1971), or in German Offenlegungsschrift Nos. 2 556 017 and 2 641 218.

The UF condensates are obtained by reaction of 1 mole of urea and 1.3 to 1.8, preferably 1.4 to 1.5, moles of formaldehyde, in aqueous solution and under suitable conditions. The reaction to obtain the UF condensate is conducted preferably in two steps. In the first step, the urea and the formaldehyde are reacted in accordance with the conventional condensation mechanism to form a low molecular water-soluble precondensate, and then, in a second step, an acid catalyst is added in order to hasten the formation of the UF condensate. An insoluble, finely particulate solid is obtained.

The amount of water in the reaction solution should advantageously not be substantially smaller than the total weight of the reactants and, during the actual formation and precipitation of the insoluble condensate particles, should always be present in substantial excess of the total weight of all other components of the reaction mixture.

The reaction temperature during the formation of the precondensate in the first step is usually in the range from 20° to 100° C., preferably from 60° to 80° C. It is advantageous to adjust the pH value to 6 to 9, preferably to 6.5 to 7.5, by adding an aqueous inorganic strong base, e.g. a solution of sodium hydroxide. The formation of the precondensate is usually complete after half an hour to 3 hours.

The formation of the precondensate is conveniently carried out in the presence of an ionic or non-ionic surfactant, e.g. a cationic quaternary ammonium compound, an anionic fatty alcohol sulfonate, a non-ionic polyethylene glycol ether, preferably a salt of a sulfosuccinate, especially sodium dodecylbenzenesulfonate. The amount of surfactant employed is usually 1 to 3% by weight, based on the sum of the weight of urea and formaldehyde used in the reaction. Ionic surfactants as a rule effect an increase in the surface area of the condensate, whereas non-ionic surfactants induce an opposite effect.

It can be expedient to use a macromolecular water-soluble protective colloid with polyelectrolyte character during the formation of the precondensate, i.e. during the first reaction step. Examples of suitable protective colloids are gelatin, tragacanth, agar-agar or polyvinyl pyrrolidones, especially polymers of acrylic and methacrylic acid, in particular polymethacrylic acid. The amount of protective colloid employed is 1 to 3% by weight, based on the sum of the weight of urea and formaldehyde. Polyvinyl pyrrolidones and polymethacrylic acid are especially suitable, as they do not effect any increase in the specific surface area.

One of the most important conditions for the successful manufacture of suitable infusible and insoluble finely particulate UF condensates is the use of a gelling catalyst in the second reaction step, e.g. of an inorganic and/or organic acid or an anhydride thereof, e.g. sulfurous acid, sulfuric acid, sulfamic acid, phosphoric acid, hydrochloric acid, chloroacetic acid, maleic acid or the anhydride thereof. In general, suitable gelling catalysts are those which have an ionisation constant greater than about $10^{-4}$. A particularly preferred gelling catalyst is sulfuric acid. The most preferred gelling catalysts are the acid ammonium and amine salts of sulfuric acid, e.g. ammonium, methylamine or ethanolamine hydrogen sulfate. These acids and salts are preferably employed in the form of 1 to 15% by weight aqueous solutions.

As a rule, 20 to 100 mmols of gelling catalyst are used per mole of urea, whereupon the pH value of the reaction mixture in the second step, i.e. in the reaction to form the condensate, is lowered to 3 to 1.5.

The second step of the formation of the UF condensate is advantageously carried out in the temperature range from 20° to 100° C., preferably from 40° to 65° C. Strong fluctuations in the temperature of the reaction mixture must be avoided when adding the gelling catalyst. It is therefore advantageous to preheat the aqueous catalyst solution to the temperature of the reaction mixture before adding this. A white gel is normally obtained within 15 to 30 seconds, whereupon the reaction is brought to completion, preferably over the course of a further ½ hour to 3 hours.

The insoluble condensate, which is obtained in the form of a white gel, is conveniently mechanically comminuted and mixed with approximately equal parts of water. The pH is adjusted with alkali or ammonia, preferably with sodium hydroxide, to 6 to 9, preferably to 7.5, and the condensate is then separated by conventional methods from the aqueous liquid, e.g. by filtration, centrifuging, or evaporating to dryness. The product can be dried by different methods, e.g. by spray drying or convection drying. Although the UF condensate consists basically of fine particles, it is advantageous to subject the solid product to comminution or deagglomeration in order to diminish the average agglomerate size and to improve the adsorption values for oil or other fluids and thus to bring it to full strength for use as auxiliary pigment within the scope of the invention. To this end the UF condensate can be comminuted in different grinding machines or impact mills, e.g. in ball mills, attrition mills, jet mills, or mills with rapidly rotating discs, to give UF condensate particles having an average particle size of 2 to 10, preferably 4 to 6, microns ($\mu$m). The primary particles have a diameter of 0.1 to 0.5 $\mu$m, preferably 0.11 to 0.35 $\mu$m. The UF condensates are used in the recording material preferably in an amount of 3 to 30% by weight, based on the solids content of the coating composition. The solids content of the coating composition is generally 15 to 60% by weight.

The pressure-sensitive recording material of this invention can also be a copying material. It consists preferably of at least one pair of sheets which are sensitised with coatings which, in addition to containing the UF sulfate, calcium sulfoaluminate, zinc oxide, silica, calcium carbonate, inert clays and/or kaolins, especially spreading kaolin.

In addition to the colour developer, UF condensate and, optionally, the pigment, the coating compositions can contain further assistants, e.g. emulsifiers of the anionic, cationic or non-ionic type, dispersants, plasticisers, UV absorbers, antifoams and/or fungicides.

By adding the UF condensate employed in this invention to the coating on a colour developing sheet which contains, in particular, an activated mineral clay such as activated bentonite, it is possible to increase the degree of whiteness and, in addition, to achieve increased resistance to yellowing. In particular, a marked improvement in the speed of colour development and, most particularly, of the colour intensity, is achieved. This improvement is primarily attributable to the excellent oil absorption of the UF condensate.

The invention is illustrated by the following Examples, in which parts and percentages are by weight, unless otherwise indicated.

EXAMPLE 1

A solution of 3 g of crystal violet lactone and 1.5 g of benzoyl leucomethylene blue in 80 g of partially hydrogenated terphenyl and 20 g of kerosene is microencapsulated by coacervation in known manner with gelatin and gum arabic, and the suspension of microcapsules is mixed with starch solution and coated on paper. The weight of dry coating is 6 g/m$^2$.

The face of a second sheet is coated with an aqueous suspension having a solids content of 25% and consisting of 76 parts of acid-activated clay, 16 parts of spreading kaolin, 8 parts of UF condensate (BET specific surface area 6.5 m$^2$/g; product A of German Offenlegungsschrift No. 2 556 017), 0.3 part of polyphosphate as dispersing agent, 7 parts of a butadiene/styrene copolymer, and 11 parts of oxidised starch. The pH of the suspension is adjusted to 8 with sodium hydroxide solution. The coating weight is 7 g/m$^2$.

The first sheet and the sheet coated with developer and UF condensate are laid on each other with the coatings face to face. Pressure is exerted by writing on the first sheet by hand or typewriter, and an intense blue copy develops immediately on the sheet coated with the developer.

EXAMPLE 2

An intense blue copy is also obtained by using, as second sheet in the pressure-sensitive copying material of Example 1, a paper copy sheet which is coated with an aqueous coating composition having a solids content of 25% and containing 70 parts of acid-activated clay, 14 parts of spreading kaolin, 16 parts of UF condensate (product A of German Offenlegungsschrift No. 2 641 218; BET specific surface area 20 m$^2$/g), 0.3 part of polyphosphate, 7 parts of butadiene/styrene copolymer, and 11 parts of oxidised starch. The pH of the composition is adjusted to 8 with sodium hydroxide solution. Weight of the dry coating: 7 g/m$^2$.

The blue copy obtained in this Example is of markedly greater colour strength (colour strength 182%) than if the copy is produced under the same conditions, but without the addition of UF condensate (colour strength 100%).

EXAMPLE 3 TO 11

A coating paper having a weight of 55 g/m$^2$ is coated with one of the following compositions A, B, C and D. The coating weight is from 8.1 to 10 g/m$^2$. The coating compositions, each of which has a weight of 42.72 g and a pH of 10.1, contain in grams

| | A | B | C | D |
|---|---|---|---|---|
| acid-activated bentonite | 10 | 9 | 8 | 7 |
| UF condensate (BET specific surface area 6.5 m$^2$/g: product A of German Offenlegungsschrift 2 556 017) | — | 1 | 2 | 3 |
| tetrasodium pyrophosphate | 0.02 | 0.02 | 0.02 | 0.02 |
| styrene/butadiene copolymer | 3.0 | 3.0 | 3.0 | 3.0 |
| 1N sodium hydroxide solution | 14.7 | 13.4 | 11.4 | 9.0 |
| water | 15 | 16.3 | 18.3 | 20.7 |

The receiver sheets so prepared are printed with 1% solutions of the colour formers listed in the table in partially (40%) hydrogenated terphenyl or dibutyl phthalate (Example 8) to a depth of 18$\mu$, and the reflectance values are then measured. When using slowly developing colour formers (Examples 10, 11) and mixtures of rapidly and slowly developing colour formers (Example 9), the print is developed by Xenolight exposure before the measurement is made. The colour strength of the print obtained with each individual colour former on the receiver sheet coated with composition A is assumed to be 100%. Using the sheet coated with composition A as reference standard, the prints obtained on the sheets coated with compositions B, C and D are measured for their colour strength. The measurements to determine the relative colour strength are made after storage in the dark for 1 hour and 7 days respectively. The results are reported in the following table. It is evident from the table that addition of the UF condensate results in an improvement of the colour intensity.

TABLE

| Example | colour former | coating weight in g/m$^2$ | | | | Relative colour strength after 1 hour | | | | Relative colour strength 7 days | | | |
|---|---|---|---|---|---|---|---|---|---|---|---|---|---|
| | | A | B | C | D | A | B | C | D | A | B | C | D |
| 3 | 3,3-bis-(4'-dimethylaminophenyl)-6-dimethylaminophthalide | 9.4 | 9.6 | 9.4 | 9.8 | 100 | 135 | 156 | 138 | 100 | 115 | 107 | 91 |
| 4 | 3,3-bis-(1'-ethyl-2'-methyl-indol-3'-yl)-phthalide | 9.4 | 9.8 | 9.4 | 9.8 | 100 | 136 | 169 | 179 | 100 | 120 | 141 | 147 |
| 5 | 1,3-bismethyl-6-diethylamino-fluorane | 9.3 | 8.3 | 7.9 | 8.8 | 100 | 143 | 159 | 201 | 100 | 121 | 118 | 124 |
| 6 | 2-dibenzylamino-6-diethylamino-fluorane | 8.6 | 8.3 | 8.2 | 8.3 | 100 | 141 | 143 | 197 | 100 | 146 | 144 | 174 |
| 7 | 3'-phenyl-7-diethylamino-2,2'-spirodibenzopyrane | 9.6 | 9.8 | 8.5 | 10.0 | 100 | 110 | 126 | 141 | | | | |
| 8 | bis-(4-dimethylamino)-benzhydrol-p-toluene-sulfinate | 8.6 | 8.7 | 8.2 | 8.2 | 100 | 125 | 126 | 110 | | | | |
| 9 | § 3,3-bis-(4'-dimethylamino- | 9.3 | 9.6 | 8.5 | 10.0 | 100 | 137 | 257 | 241 | | | | |

TABLE-continued

| Example | colour former | coating weight in g/m² | | | | Relative colour strength after 1 hour | | | | Relative colour strength 7 days | | | |
|---|---|---|---|---|---|---|---|---|---|---|---|---|---|
| | | A | B | C | D | A | B | C | D | A | B | C | D |
| | phenyl)-6-dimethylaminophthalide ⅓ bis[4-N—methyl-N—phenylamino-phenyl]-N'—butyl-carbazol-3'-yl-methane* | | | | | | | | | | | | |
| 10 | 3,7-bis-(dimethylamino)-10-benzoyl-phenothiazine** | 9.2 | 8.2 | 8.1 | 9.2 | 100 | 156 | 122 | 112 | | | | |
| 11 | bis-(4-N—methyl-N—phenylamino-phenyl)-N'—butyl-carbazol-3'-yl-methane* | 9.2 | 8.8 | 8.1 | 9.3 | 100 | 132 | 167 | 186 | | | | |

Xenolight exposure*80 minutes
Xenolight exposure**60 minutes

What is claimed is:

1. A pressure-sensitive recording material which contains, on at least one support, at least one colour former and one inorganic developer therefor applied in the form of coatings, said inorganic developer coating or coatings additionally containing a urea-formaldehyde condensate with a BET specific surface area of 6.5 to 20 $m^2/g$.

2. A recording material according to claim 1, wherein the specific surface area of the urea-formaldehyde condensate is 6.5 to 12 $m^2/g$.

3. A recording material according to claim 1, wherein the urea-formaldehyde condensate has an average particle size of 2 to 10 $\mu m$.

4. A recording material according to claim 3, wherein the urea-formaldehyde condensate has an average particle size of 4 to 6 $\mu m$.

5. A recording material according to claim 1, wherein the inorganic developer coating or coatings contain 3 to 30% by weight of the urea-formaldehyde condensate.

6. A recording material according to claim 1, wherein the colour former is present in the coating on the back of a transfer sheet.

7. A recording material according to claim 1, wherein a solution of the colour former in an organic solvent is encapsulated in microcapsules.

8. A recording material according to claim 1, wherein the developer for the colour former and the urea-formaldehyde condensate are present in the coating on a receiver sheet.

9. A recording material according to claim 1, wherein the developer for the colour former is an activated mineral clay.

10. A recording material according to claim 9, wherein the activated mineral clay is activated bentonite.

11. A recording material according to claim 1, wherein the support is paper.

12. A colour developer sheet for a pressure-sensitive recording material consisting of a support on which there is present a coating which comprises at least one inorganic developer and a urea-formaldehyde condensate having a BET specific surface area of 6.5 to 20 $g/m^2$.

* * * * *

United States Patent [19]

Buffington

[11] 4,431,214

[45] Feb. 14, 1984

[54] DATA GUIDE DEVICE

[75] Inventor: Veronica A. Buffington, Irvington, N.J.

[73] Assignee: Federal Paper Board Co., Inc., Montvale, N.J.

[21] Appl. No.: 187,569

[22] Filed: Sep. 15, 1980

[51] Int. Cl.[3] ..... B42D 15/00; G09F 11/00

[52] U.S. Cl. ..... 283/65; 40/491; 428/542; 493/355; 493/399

[58] Field of Search ..... 283/44, 65, 6, 61; 40/489, 490, 491; 281/2; 434/172, 405; 493/944, 959, 355, 354, 399, 398, 397; 428/542; 282/22 R

[56] References Cited

U.S. PATENT DOCUMENTS

| | | | |
|---|---|---|---|
| 3,058,401 | 10/1962 | Cross | 493/944 X |
| 3,081,111 | 3/1963 | Kehoe | 282/22 R |
| 3,562,940 | 2/1971 | Gulbransen | 40/491 |
| 3,593,443 | 7/1971 | Demetrius | 283/6 X |
| 3,758,136 | 9/1973 | Guyer | 281/31 X |
| 3,902,656 | 9/1975 | Rothchild | 229/75 |
| 4,233,768 | 11/1980 | Bromberg | 283/65 X |
| 4,262,939 | 4/1981 | Schoettle | 283/65 |

*Primary Examiner*—James M. Meister
*Assistant Examiner*—John S. Brown
*Attorney, Agent, or Firm*—August E. Roehrig, Jr.

[57] ABSTRACT

The disclosed device comprises a pair of hingedly connected pocket formations receiving data cards which are derived by folding and connecting a plurality of initially integral panels, the panels being formed by cutting and scoring a blank of paperboard of relatively light gauge, and thereafter being folded and secured so as to provide the hingedly connected pocket formations in each of which an end panel of the blank forming the data card is confined and is accessible through an open end so as to enable it to be torn loose and to be moved to different positions in the pocket thereby enabling data imprinted thereon to be viewed through window openings in a wall forming panel on which related data may be imprinted.

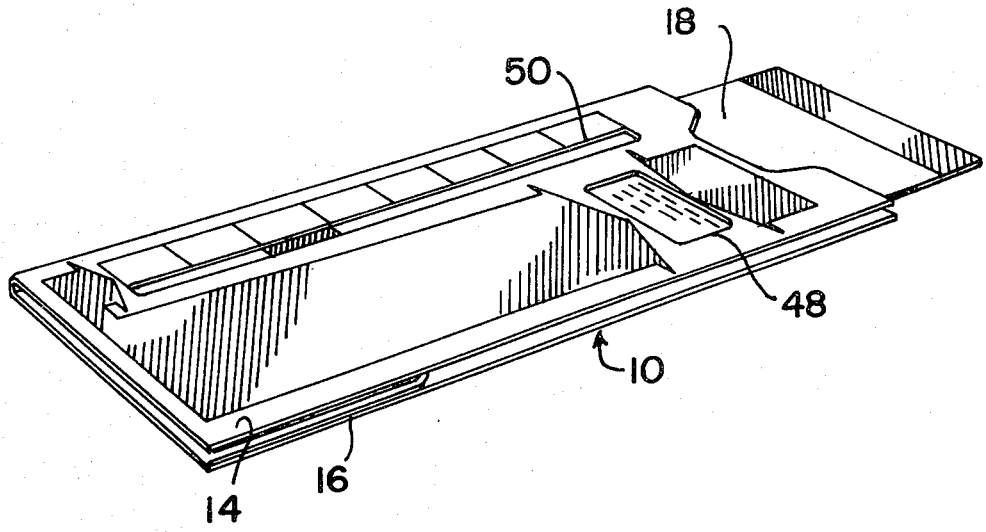

6 Claims, 7 Drawing Figures